US010961646B2

(12) United States Patent
Reinders

(10) Patent No.: US 10,961,646 B2
(45) Date of Patent: Mar. 30, 2021

(54) SYSTEM FOR MAKING A LOOP

(71) Applicant: Peter Reinders, Ochtrup (DE)

(72) Inventor: Peter Reinders, Ochtrup (DE)

(73) Assignee: SCHMALE-HOLDING GMBH & CO., Ochtrup (DE)

( * ) Notice: Subject to any disclaimer, the term of this patent is extended or adjusted under 35 U.S.C. 154(b) by 84 days.

(21) Appl. No.: 16/526,094

(22) Filed: Jul. 30, 2019

(65) Prior Publication Data

US 2020/0040501 A1 Feb. 6, 2020

(30) Foreign Application Priority Data

Aug. 3, 2018 (DE) ..... 102018118937.0

(51) Int. Cl.
*D05B 35/06* (2006.01)
*B65H 69/00* (2006.01)
*B65H 51/10* (2006.01)

(52) U.S. Cl.
CPC ..... *D05B 35/066* (2013.01); *B65H 51/105* (2013.01); *B65H 69/00* (2013.01); *D05D 2303/20* (2013.01)

(58) Field of Classification Search
CPC ..... D05B 35/066; D05B 35/06; B65H 69/00; B65H 51/105; D05D 2303/20; D05D 2305/02
See application file for complete search history.

(56) References Cited

U.S. PATENT DOCUMENTS 2,158,144 A * 5/1939 Oskow ..... B31D 1/022 493/341
3,381,639 A * 5/1968 Miller ..... D05B 33/00 112/130
3,680,509 A * 8/1972 Miller ..... D05B 35/062 112/152
4,920,904 A * 5/1990 Frye ..... D05B 35/06 112/114
5,040,472 A * 8/1991 Schips ..... B65C 9/183 112/104
5,599,410 A 2/1997 Reinders
5,983,814 A * 11/1999 Block ..... D05B 35/066 112/2.1

* cited by examiner

*Primary Examiner* — Tajash D Patel
(74) *Attorney, Agent, or Firm* — Andrew Wilford

(57) ABSTRACT

A strip is fastened to an edge of a textile piece by first advancing strip of the ribbon in a direction parallel to the strip of ribbon from a supply. Then a leading end of the strip is gripped a first nip point while advancing additional ribbon from the ribbon supply. The strip is then gripped at a second nip point upstream of the first nip point at a trailing end of the strip. The ribbon is then severed upstream in the strip-travel direction of the second nip point to separate the strip from the ribbon into a sufficient length between the first nip point and the second nip points. The leading or trailing end is then pivoted about at least one pivot axis relative to the other end and positioned near or on the other end, which is then fastened to the edge of the textile piece.

21 Claims, 4 Drawing Sheets

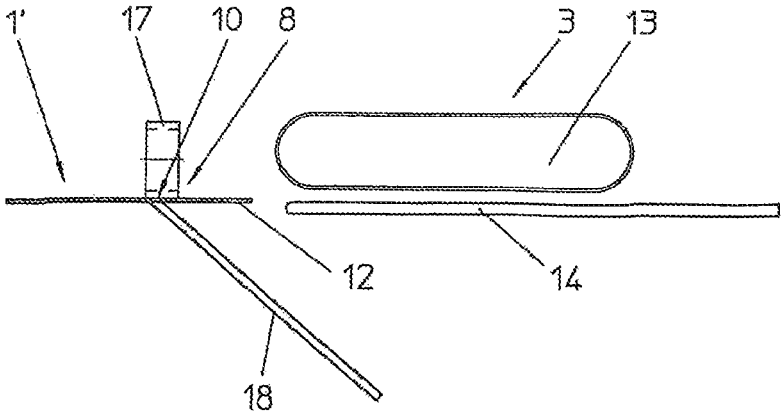
Fig. 7
Fig. 8
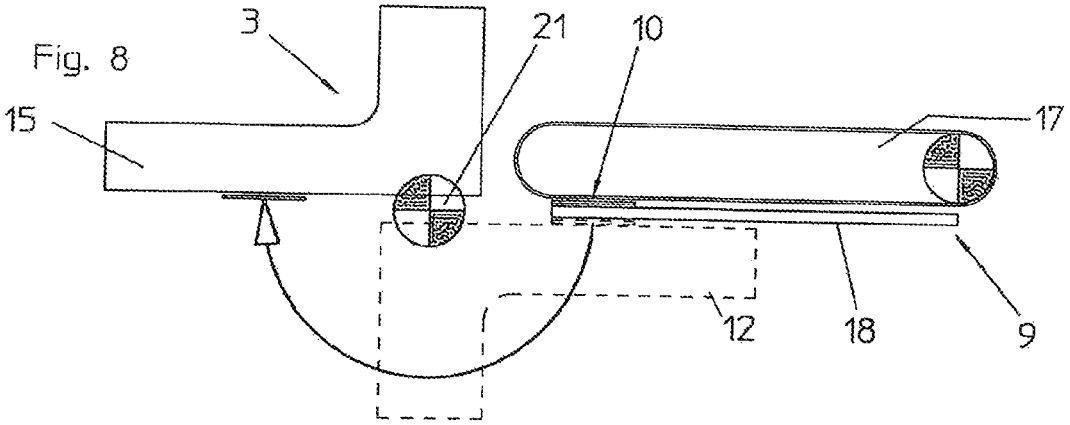
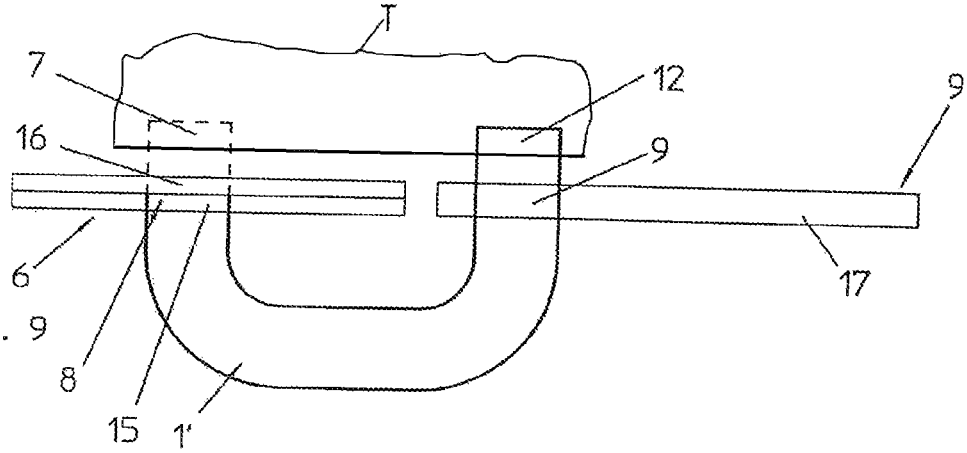
Fig. 9

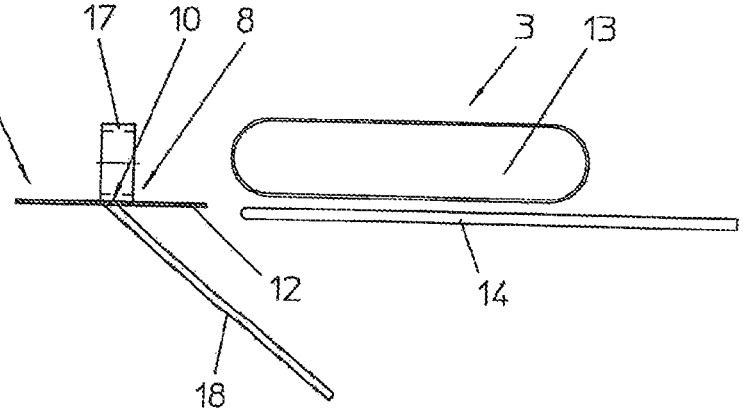
Fig. 10
Fig. 11
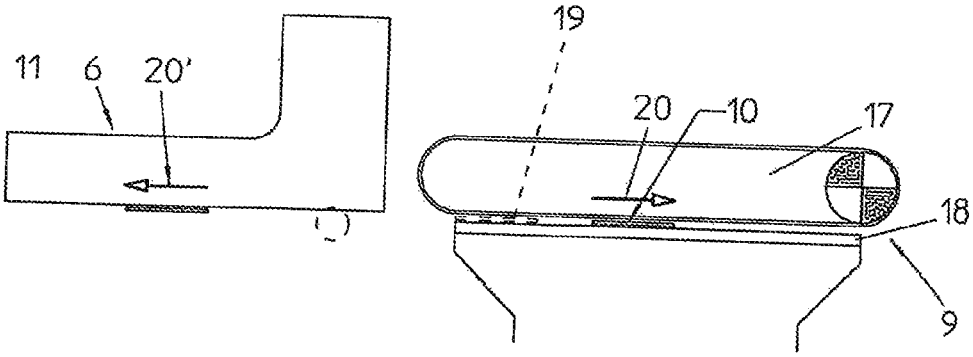
Fig. 12
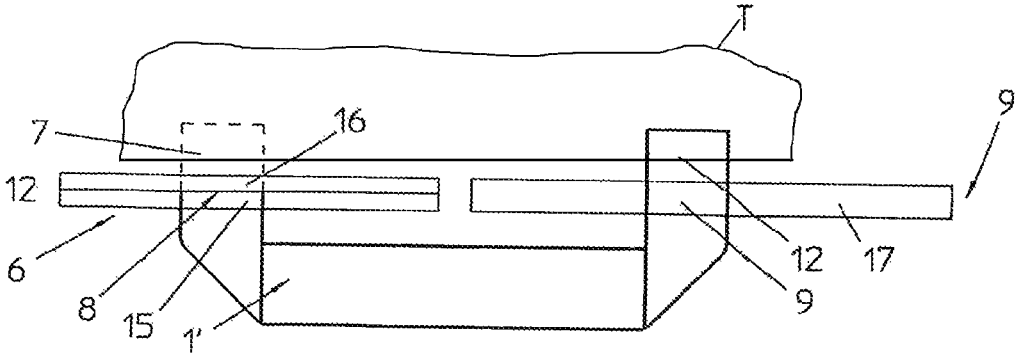

SYSTEM FOR MAKING A LOOP

FIELD OF THE INVENTION

The present invention relates to making a loop. More particularly this invention concerns a method and apparatus for making a loop usable, for instance as a handle for a bag or label for a product.

BACKGROUND OF THE INVENTION

A loop for attachment to a piece of textile is typically made from a piece of a flexible ribbon that is fixed to the a textile piece.

Such an apparatus and method are well known in the art. U.S. Pat. No. 5,599,410 discloses an apparatus and a method of the operation thereof with which labels, including loop-fold labels, are produced from ribbon. Ribbon introduced into a feeder is transported by the feeder toward a gripper. The gripper picks up the ribbon, namely an end of the ribbon, while the feeder is moved back to its starting position. A folding plate is then set in motion whose direction of movement is aligned perpendicular to the gripped surface of the ribbon. The folding plate is moved in the strip-travel direction and folds it lengthwise, thereby forming a simple loop. The folding plate is retracted together with the strip into a positioning gripper that closes simultaneously with a pair of scissors that separates the ribbon into a single ribbon, with the positioning gripper picking up the finished folded loop while the folding plate is returned to its starting position. The ends of the strip are then welded, and the loop is advanced to a sewing station, where it is fixed to the seam of a textile in the form of a label.

Alternatively, the apparatus can also be used to produce a flag label. In that case, the folding plate is advanced further after the scissors have severed the strip, and the loop that was previously folded in the a positioning gripper is straightened. Only after the a positioning gripper close, can the little flag be fixed as a flag label to a textile piece.

Moreover, it is possible to produce U-shaped loops. The apparatus must be expanded for that purpose, however. In this embodiment, a carriage that enables the width of the ribbon to be varied is provided with a guide on the machine frame. In addition, a shaping plate and a U-shaped folding plate are one above the other in the apparatus, the ribbon resting on the shaping plate. The folding plate is moved downward from a position above the strip portion and moved relative to the shaping plate, so that it is below the level of the ribbon. Due to movement of the folding plate relative to the shaping plate, the legs of the strip are folded, thus forming a U-shaped loop. The shaping plate then pushes the loop in the manner described into the a positioning gripper.

The solutions that are known from the prior art have the disadvantage that different apparatuses are required in order to produce different label formats, so that in the event of a change in production, for example from a simple loop-fold label to a U-shaped label, elaborate modifications must be made to the apparatus, requiring replacing the apparatus for making a simple loop-fold label with another apparatus for making a U-shaped label. Although EP 0 607 196 discloses an apparatus that can make different types of label, additional elements must also be introduced into the apparatus to be able to produce a U-shaped label, for example. A V-shaped label cannot be made with this apparatus at all.

OBJECTS OF THE INVENTION

It is therefore an object of the present invention to provide an improved system for making a loop.

Another object is the provision of such an improved system for making a loop that overcomes the above-given disadvantages, in particular that can make a variety of label formats in an especially cost-effective and simple manner.

SUMMARY OF THE INVENTION

According to the invention the method comprises the steps of sequentially:

advancing a strip of the ribbon in a strip-travel direction extending parallel to the strip of ribbon from a ribbon supply;

gripping a leading end of the strip in the strip-travel direction at a first nip point while advancing additional ribbon from the ribbon supply;

gripping the strip at a second nip point spaced from the first nip point at a trailing end of the strip spaced upstream from the first nip point;

severing the ribbon upstream in the strip-travel direction of the second nip point to separate the strip from the ribbon into a single strip of sufficient length between the first nip point and the second nip points;

pivoting the leading end or the trailing end about at least one pivot axis relative to the other end, or positioning the leading end or the trailing end relative to the other end, or positioning both ends relative to each other in the plane of the strip or parallel to this plane so that a simple loop or a U-shaped loop or a V-shaped loop is formed in which the leading and trailing ends are oriented one above the other or overlap at least partially or are next to each other;

aligning the positioned leading and trailing ends are transverse to an edge of a textile piece and positioning the leading and trailing ends thereon, or aligning the leading and trailing ends from an aligning position that deviates from a transverse to the edge of the textile piece into a position in which they are positioned transverse to the edge of the textile piece; and fixing the loop at the ends to the textile piece.

The ribbon formed into a loop can be a flat ribbon, a cord, or any other tape-like material having a considerable length, a modest width, and a very small thickness. Any flexible material can be used as the ribbon.

The end of the strip leading in the strip-travel direction is gripped upon reaching a certain position. After the gripping at the first nip point, additional ribbon is advanced from the ribbon supply or fed off a ribbon supply spool until the strip is of sufficient length to form a loop.

To achieve this, the ribbon can be advanced further by a conveyor, for example, and quasi pushed and transported past the nip point, whereupon the further-advanced ribbon turns over and forms a loop. The ribbon is advanced until the strip has formed a simple loop of sufficient length.

Alternatively, however, the ribbon can also be advanced from the ribbon supply by a gripper that holds the strip at the first nip point, for example by moving the gripper in the strip-travel direction and pulling on the ribbon until the strip has sufficient length to form a loop. In this case, no loop is produced initially, but rather the strip forms a straight strip.

Once the strip is present as a simple loop or as a straight strip, a trailing end of the strip is gripped and held at a second nip point spaced upstream from the first nip point.

If a simple loop has already been formed and the strip is gripped at the first and second nip point, the nip points lie one above the other. The ribbon is severed upstream in the strip-travel direction of the second nip point, and the simple loop can be fixed to the edge of the textile piece.

Alternatively, the simple loop can be further processed by positioning the leading end or the trailing end relative to the other end in the plane of the strip transverse to the strip-travel direction such that the ends are next to each other and a V-shaped loop is formed from the simple loop. It is also possible for both ends to be moved relative to each other in the plane of the strip transverse to the strip-travel direction so that the ends are next to each other and a V-shaped loop is formed.

Alternatively, the simple loop can be further processed such that one of the ends is pivoted about a pivot axis relative to the other end and a U-shaped loop is formed. Preferably, one of the ends is then moved relative to and away from the other end in the plane of the strip, so that the U-shaped loop is tensioned. It is also possible to move both ends away from each other on this plane in order to tension the loop.

If the ribbon is being advanced straight out of the ribbon supply and no looping has taken place, the leading end or the trailing end can be pivoted about at least one pivot axis so that the ends are one above the other or overlap at least partially or are next to each other and the strip forms a simple loop, a V-shaped loop, or a U-shaped loop. If the ends are one above the other after pivoting and the strip is formed into a simple loop, then at least one of the ends can be moved away from the other end in the plane of the strip so that the ends are next to each other and, instead of the simple loop, a V-shaped loop is formed. Movement of one end away from the other end or of both ends away from each other can also occur when the ends are next to each other and the strip forms a U-shaped loop in order to tension the loop into a U-shape with spaced-apart legs.

Alternatively, if the ribbon is being fed from the ribbon supply and no looping has occurred, one of the ends can be moved relative to the other end or both ends can be moved relative to each other in the plane of the strip or parallel to this plane. In this way, it is possible to produce a simple loop shape, namely if the leading end or the trailing end is moved toward the other end or both ends are moved toward each other, so that the ends are one over the other, or a V-shaped loop, namely if both ends or the leading end or the trailing end is moved obliquely toward the other end, so that the ends are next to each other or overlap at least partially.

The ribbon is severed as it is moved in the strip-travel direction upstream of the second nip point. The severing can occur after the gripping at the second nip point and optionally before the ends are pivoted or moved, in which case there is the advantage that both ends are freely movable during pivoting or positioning. However, the severing can also occur only after pivoting or positioning, in which case there is the advantage that time can be saved.

Depending on the orientation of the loop, the leading end and the trailing end must then be aligned in a position transverse to the textile piece in order to position the ends on the edge of the textile piece and enable the ends to be fastened to the textile piece. This is necessary, for example, when the strip-travel direction runs parallel to the edge of the textile piece. In this case, the ends of the fully formed loop face away from the edge of the textile piece and must extend toward the edge in order to enable them to be fastened to the textile piece. The alignment can be done by positioning or pivoting the ends or in any other way.

If the loop is already correct upon being formed. i.e. aligned transverse to the edge of the textile piece. then no alignment of the ends is necessary. This correct alignment is achieved if the strip-travel direction extends approximately transverse to the edge of the textile piece.

The formed loop can then be fixed in any manner to the textile piece.

The method steps are especially simple, variable, and inexpensive to implement and can all be performed in a compact apparatus with a simple construction. This eliminates costly modifications or conversion measures that had to be carried out with conventional methods when the production was to be changed over from one label format to another label format. With the present method, it is sufficient to program the apparatus carrying out the method according to the desired loop formation and to adjust the sequence or the execution of the method steps accordingly.

Preferably, the strip-travel direction does not extend parallel but rather preferably substantially transverse to the edge of the textile piece.

A strip of the ribbon is preferably brought to the textile approximately transverse to the edge of the textile piece. By virtue of this orientation, for example transverse to the edge region, the advantage arises that all label formats can be fixed without subsequent rotation of the loop to the edge of the textile piece.

The expression "transverse to the strip-travel direction" should not be understood to mean that it must necessarily be a perpendicular orientation; for example, oblique orientations are included as well.

Preferably, the pivot axis extends substantially perpendicular and/or parallel to the plane of the strip of ribbon.

If a simple loop has already been formed after the feeding of the ribbon and the strip is gripped at a first and at a second nip point, the ends or nip points are one above the other. One of the ends is then pivoted about a pivot axis parallel to the plane of the strip relative to the other end, so that the simple loop is formed into a U-shaped loop. The pivoting about the parallel pivot axis is especially advantageous because no intervention occurs in the region in front of the strip, for example the advancing region of the textile piece; instead, the movement takes place next to the textile piece or the edge region thereof.

If the ribbon is being advanced straight out of the ribbon supply and no looping has yet taken place, the leading end or the trailing end is pivoted about at least one axis. If one of the ends is pivoted about a pivot axis aligned substantially perpendicular to the plane of the strip, a U-shaped loop is formed.

In this case, if one of the ends is pivoted about a pivot axis oriented substantially parallel to the plane of the strip, then a simple loop or a V-shaped loop is formed.

If the ribbon is being advanced straight out of the ribbon supply and no looping has yet taken place, if one of the ends is first pivoted about a pivot axis aligned substantially parallel to the plane of the strip, then a simple loop is formed. This end can be pivoted about an additional pivot axis aligned substantially perpendicular to the plane of the strip, whereby a U-shaped loop is formed.

The leading or trailing end can thus be pivoted about a pivot axis that runs parallel or perpendicular to the plane of the strip of ribbon.

It is also possible, however, for one of the ends to be pivoted about a plurality of pivot axes, for example a pivot axis substantially perpendicular and a pivot axis substantially parallel to the plane of the strip of ribbon.

Preferably, the first nip point is moved while entraining the leading end in the strip-travel direction or parallel to the strip-travel direction until the strip is of sufficient length to form a loop.

As a result, the ribbon is pulled through the first nip point in the strip-travel direction and exerts a tensile force on the ribbon, so that it is advanced out of the ribbon supply or fed off the ribbon supply spool until the strip is of sufficient length to form a loop. The strip of ribbon then exists as a straight strip and can be formed into any loop.

Preferably, the leading end is moved to and positioned in a position outside the strip-travel path, below or above the strip-travel path, the ribbon being advanced further in the strip-travel direction via the positioning point until the desired length has been reached.

The positioning of the first nip point outside of the strip-travel path provides the advantage that, after the gripping of the first nip point, the ribbon turns over beyond the nip point as a result of the further conveyance of the ribbon and forms a loop in the desired direction. It is ensured that the ribbon does not slow down during conveyance and the formation of the loop is blocked.

Preferably the strip is severed from the ribbon before the pivoting and/or the positioning of the leading or trailing end.

The ribbon is severed upstream of the second nip point as it is moved in the strip-travel direction. The severing is preferably carried out after gripping the second nip point, since the strip is then fixed in its desired length, but optionally before pivoting or positioning, in which case the advantage is achieved that both ends are freely movable during pivoting or positioning.

Alternatively, preferably the strip is severed from the ribbon after pivoting and/or positioning of the leading or trailing end.

This results in the advantage that time can be saved during the process.

Preferably, the strip is advanced through a shaping slide advanced from a starting position while entraining the ribbon until reaching a desired end position and the ribbon forms a simple loop during advancement with gripping of the leading end occurring before the shaping slide reaches the desired end position, and the shaping slide being moved back to its starting position after reaching the end position and the leading end being held gripped for the duration of the entire displacement operation, and with gripping of the trailing end of the strip preferably occurring during the rearward displacement of the shaping slide into the starting position or after the shaping slide reaches the starting position.

The shaping slide moves toward the first nip point, it being possible for the leading end to already be held gripped before the shaping slide is advanced. Alternatively, a gripping of the leading end can also take place only after the shaping slide has already advanced a bit. In any case, gripping takes place before the shaping slide reaches the desired end position, namely the front end position, so that the ribbon is gripped during displacement into the front end position and thereby fixed. As a result, it is possible for the shaping slide to shape the ribbon into a loop by movement into the front end position. For this purpose, the shaping slide transports or pushes the ribbon above or below and past the first nip point until the strip forms a simple loop of the desired length.

After the shaping slide has reached the desired end position and formed the loop, the slider is moved back to its starting position, and the trailing end of the strip is held gripped. Meanwhile, the leading end is gripped, specifically at least for the entire duration of the entire displacement operation. Displacement of the shaping slide only ends when the shaping slide has reached its starting position again.

Gripping of the trailing end is preferably carried out while the shaping slide is being moved back to its starting position. However, it is also possible for the trailing end to be gripped only after the starting position is reached.

The gripped ends can then be moved or pivoted for further processing of the simple loop.

The shaping slide ensures for example that the loop is always formed correctly. The feed path can be set to a desired path length, the length dimension of the loop being also set.

Preferably the ribbon is advanced intermittently.

In this way, a loop can first be completed before additional ribbon is advanced.

In order to achieve the object described above, the invention proposes an apparatus according to claim 10.

The ribbon formed into a loop can be a flat ribbon, a cord, or any other flexible tape-like material.

A strip of the ribbon is brought to the textile piece by the conveyor. The ribbon is advanced until the strip is of sufficient length to form a loop.

The strip is gripped by a first gripper at a first nip point and by a second gripper at a second nip point, the strip of ribbon intended for forming a loop being formed between the nip points.

The ribbon can already be formed as a simple loop or extend as a straight strip between the clamps.

A cutter separates the ribbon in the strip-travel direction of the second nip point, so that the strip is severed and the clamps are freely movable without being attached to the ribbon supply or hindered in their movement by the connection.

If the strip is already formed into a simple loop, it can be positioned and attached directly to the edge of the textile piece, for example by sewing the loop ends to the edge. In this case, the clamps with the nip points and the ends are approximately one above the other.

However, the simple loop can also be processed further in such a way that a V-shaped or a U-shaped loop is formed by pivoting and/or positioning the clamps and/or the nip points.

By pivoting one gripper to the other clamp, the simple loop is formed into a U-shaped loop, one of the nip points is then preferably moved away from the other nip point, or both nip points are moved away from each other in the plane of the strip or parallel to this plane so that the strip is taut between the clamps.

Alternatively, a V-shaped loop is formed from the simple loop in that after the simple loop is formed, one of the nip points is moved relative to the other nip point or both nip points are moved relative to each other in the plane of the strip or parallel to this plane and the ends of the strip are next to each other and the strip forms a V-shape.

If the strip extends straight between the clamps and no looping has yet taken place, it is shaped into a simple loop shape or a V-shaped or U-shaped loop shape by pivoting or positioning the clamps or the nip points. In the case of a straight strip, the clamps are initially arranged so as to be approximately opposed in the strip-travel direction. To form a simple loop, one of the clamps is pivoted about a pivot axis relative to the other clamp, so that the clamps are together with the nip points and the ends be approximately one above the other. The strip between the clamps is thus formed into a simple loop. Subsequently, the simple loop can be further processed in that one of the nip points is moved relative to the other nip point, or both nip points are moved relative to each other in the plane of the strip or parallel to this plane such that the ends of the strip are next to each other and the strip forms a V-shape.

Alternatively, the pivoting can also take place in such a way that the clamps are together with the nip points and the ends adjacent each other or overlap partially after pivoting, thus forming a V-shaped loop.

Alternatively, there is no pivoting of the clamps to form a simple loop, but rather positioning of the nip points relative to each other. In that case, one of the approximately opposing nip points is moved relative to the other nip point in the plane of the strip or parallel to this plane, so that the nip points are together with the ends of the strips and next to each other or one above the other or overlap at least partially and the strip forms a V-shape or a simple loop. It is also possible to move both nip points relative to each other.

For the purpose of pivoting and/or positioning the clamps or the nip points, the apparatus has a pivoting device and/or a positioning device.

If one of the clamps is pivoted about a pivot axis relative to the other gripper such that a U-shaped loop is formed from the simple loop or from the straight strip, then the first nip or the second nip is preferably moved subsequently relative to the other nip point or both nip points are moved relative to each other in the plane of the strip, so that the U-shaped loop between the clamps is tensioned.

The formed loop can then be fixed in any manner to the textile piece.

A positioning device is preferably provided that positions the ends of the strip on the edge of the textile piece such that they can be fixed in a precise manner to the textile piece. The positioning device can be a second pivoting device or positioning device, for example. Depending on the orientation of the loop, the leading end and the trailing end can be aligned together with this positioning device in a position transverse to the textile piece in order to precisely position the ends on the edge of the textile piece and enable them to be fastened thereto. This is necessary, for example, if the ends of the finished loop face away from the edge of the textile piece and therefore need to be aligned and positioned toward the edge.

Preferably, a conveyor is also provided that transports the textile piece with the positioned ends of the strip to a fastening device, and the fastening device fastens the ends of the strip to the textile piece in the correct position.

This apparatus is especially simple and inexpensive to implement and can be consolidated in a compact design. The apparatus makes it possible to form different label formats without having to undertake extensive conversion measures or modifications.

Preferably, the strip-travel direction is not oriented parallel but rather preferably substantially transverse to the edge of the textile piece.

It is advantageous that all label formats can be formed from this position and the loops can be fixed to the edge of the textile piece without subsequent rotation or pivoting. The expression "transverse to the strip-travel direction" does not necessarily refer to an orientation perpendicular to the edge of the portion. Skew orientations are also included, for example.

Preferably, the pivot axis is aligned substantially perpendicular and/or parallel to the plane of the strip of ribbon.

If a simple loop has already been formed and the strip is gripped by the first and the a second gripper to the first and the nip point, the ends or the nip points are one above the other. One of the clamps can then be or is then pivoted about a pivot axis substantially parallel to the plane of the strip relative to the other gripper so that the simple loop is formed into a U-shaped loop. The pivoting about the parallel pivot axis is especially advantageous because it does not interfere with the clamps in the area in front of the apparatus, for example the area in which the textile pieces are transported.

If the strip of ribbon extends in a straight line between the clamps and no loop formation has yet taken place, the first gripper or the second gripper can be or is pivoted about at least one axis and the straight strip is formed into a simple loop. In the case of a straight strip, the clamps are initially arranged so as to be approximately opposed in the strip-travel direction.

If one of the gripper is pivoted about a pivot axis aligned substantially perpendicular to the plane of the strip, then the clamps are next to each other and the strip is formed into a U-shaped loop.

If one of the clamps is pivoted about a pivot axis aligned substantially parallel to the plane of the strip, then the clamps are one above the other and the strip is formed into a simple loop.

If the ribbon is being advanced straight out of the ribbon supply and no looping has yet taken place, if one of the clamps is first pivoted about a pivot axis aligned substantially parallel to the plane of the strip, then a simple loop is formed. This gripper can be subsequently pivoted about an additional pivot axis aligned substantially perpendicular to the plane of the strip so that a U-shaped loop is formed.

The first or second gripper can thus be pivoted about a pivot axis that runs parallel or perpendicular to the plane of the strip of ribbon.

It is also possible, however, for one of the clamps to be pivoted about a plurality of pivot axes, for example about a pivot axis substantially perpendicular and a about pivot axis substantially parallel to the plane of the strip of ribbon.

Preferably the conveyor is a belt drive with a transport base, and the ribbon is advanced between the belt of the belt drive and the transport base.

Preferably the transport base is embodied as a shaping slide or that a shaping slide is additionally arranged in the apparatus, in which case the belt drive and/or the shaping slide can be advanced from a starting position in the strip-travel direction into a working position in which the ribbon is shaped into a simple loop and can be moved back into the starting position.

The shaping slide can be moved above or below the first nip of a starting position into a working position in which the shaping slide is in a front end position, and, upon advancing from the starting position to the working position, pushes the ribbon in the strip-travel direction past the first nip point until the strip forms a U-shaped loop of the desired length. Preferably, the belt drive is entrained at least partially in the strip-travel direction.

The shaping slide and, optionally, the belt drive is then moved back to its starting position. The shaping slide ensures for example that the loop is always formed correctly. The feed path can be set to a desired path length, whereby the length dimension of the loop is also set.

For example the belt drive is set in a conveying position in which the ribbon is pressed against the transport base by the belt of the belt drive and advanced over the transport base, in which case the belt drive can be preferably moved from the conveying position to a rest position in which the belt drive disengages from the ribbon.

When the belt drive is in the conveying position, the ribbon is pressed against the transport base by the belt of the belt drive and advanced over the transport base in the strip-travel direction. In the meantime, the transport base or a shaping slide acting as a transport base can be moved along with the ribbon in the strip-travel direction in order for example to form the ribbon into a loop.

Preferably, the belt drive can also be moved to a rest position in which the belt drive does not touch the ribbon. This enables the ribbon to move freely in the strip-travel direction together with the transport base or the shaping slide in a simple manner. This is also advantageous if the ribbon is being advanced out of the ribbon supply by the first gripper or fed off the ribbon spool, since the ribbon can be advanced without resistance.

Preferably the first gripper can be moved while entraining the leading end in the strip-travel direction or parallel to the strip-travel direction.

As a result, the first gripper tautens the ribbon and pulls it out of the ribbon supply or off the ribbon spool.

Preferably, the first and/or the second gripper has or is a conveyor with which the leading end and/or the trailing end can be moved away from the other end.

If the strip is already a U-shaped loop, this can position the nip points and hence the ends, and the strip can be tensioned between the clamps.

Alternatively, if the nip points lie one over the other and the strip forms a simple loop, a V-shaped loop can be formed as a result of the movement apart.

Preferably the first and/or the second gripper is a pair of relatively movable gripper elements.

Preferably the first and/or the second gripper is a belt drive with a support element situated opposite the belt drive, the strip being arranged with its first and/or second nip point between the belt or the feed roller of the belt drive and the support element.

The first and/or second gripper can thus gripper at the first and/or second nip point and acts as an adjuster for orienting the nip points relative to each other. The combination of the two functions in one element is especially space-saving.

For the same reason, the first and/or the second gripper is an adjustable clamp, in which case the strip is held gripped with its first and/or second nip point between components of the gripper and can be moved with the clamp.

Preferably, the ends project past the nip points and can be fixed to the textile piece with the projecting portion.

The projecting portions of the leading and trailing ends can be easily fixed to the edge of the textile piece.

In addition, an adjustable computer control is provided that corresponds to the apparatus components and controls their activities and functions, namely the conveyor,.

the first clamp, the second clamp, the cutter, the pivoting device, the adjuster, the positioning device, and the fastening device.

The computer control, which can be operated by the user of the apparatus, allows the user to easily enter settings in order to achieve the desired loop shape, loop length, loop positioning, and other useful parameters. The apparatus itself remains unchanged, so no time- and cost-intensive conversion measures are required, but rather only simple programming of the adjustable computer control.

BRIEF DESCRIPTION OF THE DRAWING

The above and other objects, features, and advantages will become more readily apparent from the following description, reference being made to the accompanying drawing in which:

FIG. 7 is a side view of the apparatus with pivoted second clamp;

FIG. 8 is a front view of the apparatus;

FIG. 9 is a top view of the apparatus;

FIG. 10 is a side view of the apparatus with pivoted and moved second clamp;

FIG. 11 is a front view of the apparatus; and

FIG. 12 is a top view of the apparatus.

SPECIFIC DESCRIPTION OF THE INVENTION

Figure 1:
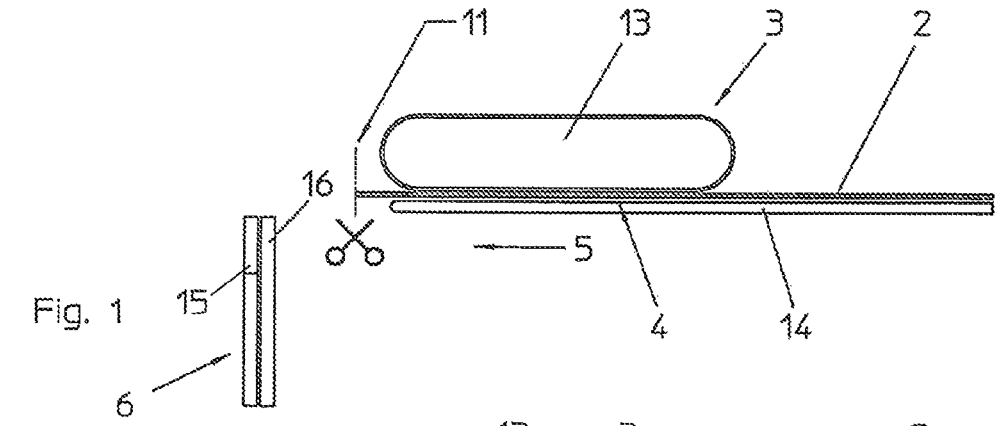
FIG. 1 is a side view of a apparatus according to the invention in the starting position.

FIGS. 1 to 12 show the inventive method steps of first forming a loop 1, 1' made of flexible ribbon 2 and then fixing the loop 1, 1' to the edge of a textile piece whose outline only is shown schematically at T in FIGS. 4, 5, 6, 9, and 12, and a possible embodiment of an apparatus for carrying out the method.

For forming the loop 1, 1' from flexible ribbon 2 and for fixing the loop 1, 1' to the textile piece T, particularly to its edge, the apparatus has a conveyor 3 that moves a strip 4 of the ribbon 2 in a strip-travel direction 5 extending parallel to the strip 4 of ribbon but not parallel to and preferably transverse to the edge of the textile piece T from a ribbon supply or pulls it off a ribbon supply spool in a length sufficient to form a loop, a first gripper 6 gripping a leading end 7 of the strip 4 in the strip-travel direction 5 at a first nip point 8 of the strip 4, a second gripper 9 gripping the strip 4 at a second nip point 10 spaced from the first nip point 8 for forming a loop forming between the nip points 8, 10 the strip 4 of ribbon, a cutter 11 for severing from the ribbon 2 a single strip 4 having after severing a trailing end 12 and with the second nip point 10 being at the trailing end 12, preferably a pivoting device that can pivot the first gripper 6 relative to the second gripper 9 about at least one pivot axis 21 aligned substantially parallel to a plane of the strip 4 of ribbon, and preferably an adjuster that can position the second nip point 10 relative to the first nip point 8 in the plane of the strip 4 or parallel thereto so that the strip 4 of ribbon forms a U-shaped loop 1' whose ends 7, 12 are next to each other and are positioned on and fixable to the edge of the textile, preferably a positioning device that positions the ends 7, 12 at the edge of the textile piece T and a conveyor that transports the textile piece T with the positioned ends 7, 12 of the strip to a fastening device that fastens the ends 7, 12 of the strip to the textile piece T in a correct position.

The ribbon 2 formed into a loop 1, 1' can be a flat ribbon, a cord, or any other ribbon.

FIG. 1 shows the starting situation in which the ribbon 2 is advanced from the ribbon supply located to the right or fed off a ribbon supply spool. The ribbon 2 is preferably advanced intermittently. In this way, it is always possible for a loop 1, 1' to be completed before additional ribbon 2 is advanced.

The ribbon 2 is advanced in a strip-travel direction 5 extending parallel to the strip 4 of ribbon and not parallel but preferably transverse to the edge of the textile piece T in the form of a strip 4 from the ribbon supply or fed off the ribbon supply spool in a length sufficient to form a loop. By virtue of this orientation, for example transverse to the edge of the textile piece T, the advantage arises that all label formats can be fixed without subsequent rotation or pivoting of the loop 1, 1' to the edge of the textile piece T.

FIG. 1 shows the first gripper 6 embodied here as a gripper that is initially closed and intended to later grip and hold the ribbon 2 at the first nip point 8.

The conveyor 3 is a belt drive 13 with for example a transport base 14 constituted as a shaping slide and the ribbon 2 being advanced between the belt of the belt drive 13 and the transport base 14. The direction of rotation of the belt drive is indicated in FIG. 2 with an arrow.

Figure 3:
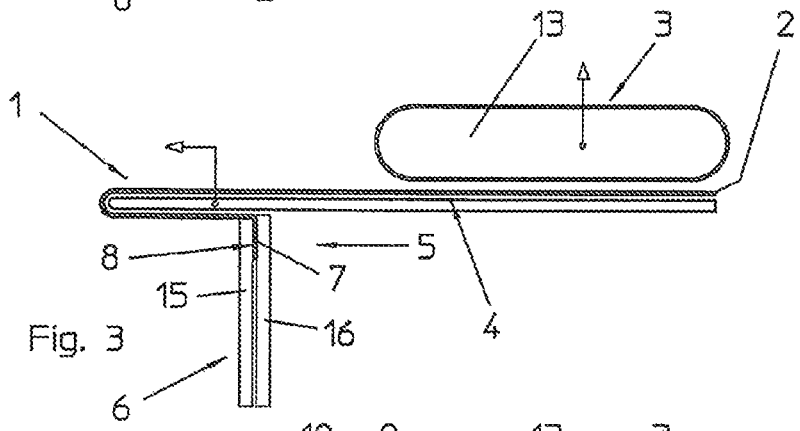
FIG. 3 is a side view of the apparatus with a closed gripper and advanced shaping slide.
Figure 4:
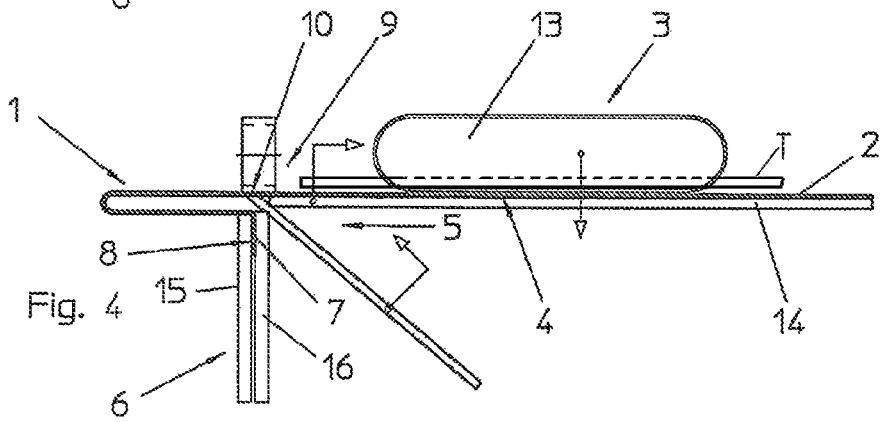
FIG. 4 is a side view of the apparatus with retracted shaping slide and closed second clamp.
Figure 5:
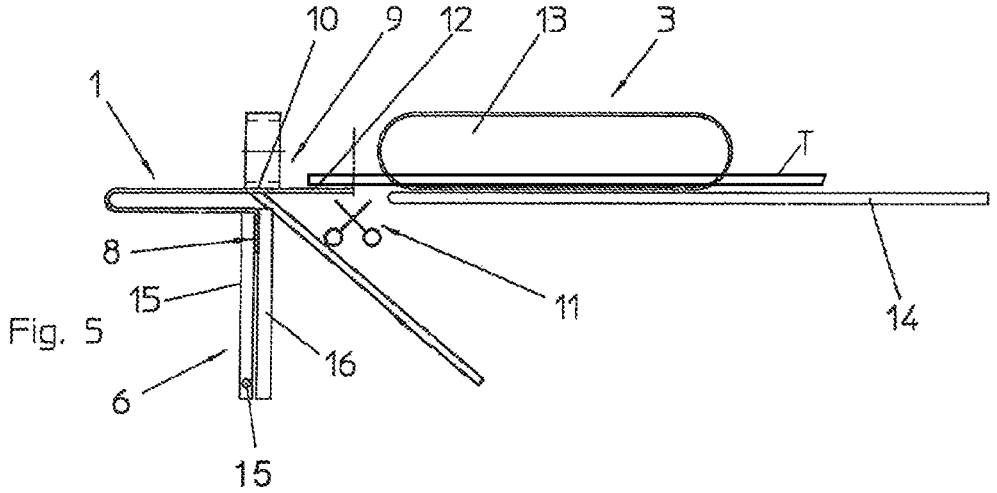
FIG. 5 is a side view of the apparatus after severing of the strip of ribbon from the ribbon.
Figure 6:
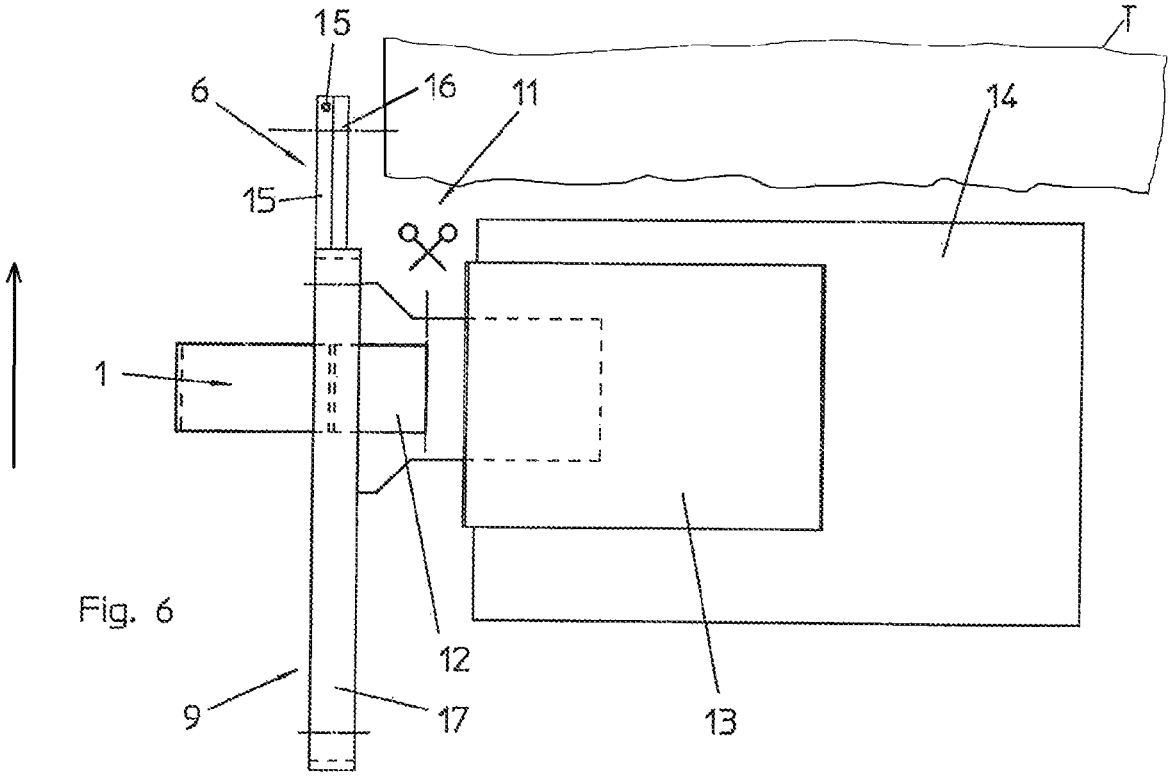
FIG. 6 is a top view of the apparatus as shown in FIG. 5.

The shaping slide 14 can be moved from the starting position shown in FIG. 1 while entraining the ribbon 2 in the travel direction 5 of the strip 4 (toward the left) into a working position shown in FIG. 3 and in which the shaping slide 14 is in the desired upstream end position in which the ribbon 2 is formed into a simple loop 1 and the slide 14 can be moved back again into the starting position (see FIG. 4 and FIG. 5). Also, the belt drive 13 is movable at least over a portion of the feed path together with the shaping slide 14 in the strip-travel direction 5 in order to bring the ribbon 2 to the first gripper 6.

In order to enable the shaping slide 14 to entrain the ribbon 2 in the strip-travel direction 5, the belt drive 13 can be moved from a conveying position in which the ribbon 2 is pressed by the belt of the belt drive 13 against the transport base 14 and is advanced over the transport base 14, into a rest position in which the belt drive 13 releases the ribbon 2. The conveying position is illustrated for example in FIGS. 1, 2 and 4. FIG. 3 shows the rest position of the belt drive 13 in which the belt drive 13 does not touch the ribbon 2. In this position, the ribbon 2 can be easily moved downstream together with the shaping slide 14 in the strip-travel direction 5.

Figure 2:
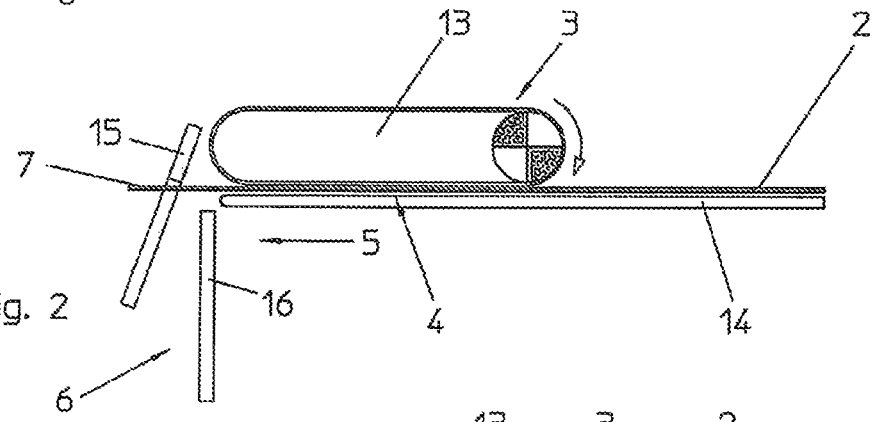
FIG. 2 is a side view of the apparatus with an open gripper.

FIG. 2 shows the apparatus with an open gripper. The gripper is opened before the ribbon 2 or its leading end 7 reaches the gripper 6 so that the ribbon 2 can be passed through the opening formed by the open legs 15, 16 of the gripper 6. While entraining the ribbon 2, the shaping slide 14 pushes the leading end 7 of the strip 4 in the strip-travel direction 5 toward the open gripper 6 until the end 7 has been advanced through the open gripper 6 in the desired length. Then the gripper closes so that the leading end 7 of the strip 4 is gripped at the first nip point 8 by the gripping legs 15, 16 of the gripper 6 (for example, see FIG. 3 and FIG. 4).

As FIGS. 3 and 4 show, the leading end 7 is pivoted into a position outside the strip-travel path of the ribbon and below the strip-travel path, the ribbon 2 being advanced further in the strip-travel direction 5 via the positioning point 8 until the desired length of the loop 1 has been reached. The positioning of the first nip point 8 outside the strip-travel path provides the advantage that the shaping slide 14 can be pushed along with the ribbon 2 past the first nip point 8.

As FIG. 3 shows, the shaping slide 14 is moved above the first nip point 8 from the starting position into a working position (the desired end position) and, upon advancing from the starting position to the working position, pushes the ribbon 2 in the strip-travel direction 5 past the first nip point 8 or the first gripper 6 until the strip 4 forms a simple loop 1 of the desired length. The length depends on the stroke length of the shaping slide 14. Then, as shown in FIG. 4, the shaping slide 14 is moved back until it has reached its starting position (FIG. 5). The shaping slide 14 ensures for example that the loop 1 is always formed correctly. The feed path can be set to a desired path length, and the length dimension of the loop 1 is also set.

The strip 4 is then gripped at a second nip point 10 by the second gripper 9, as shown for example in FIG. 4, the second nip point 10 being spaced vertically from the first nip point 8 and arrests the trailing end 12 of the strip 4. The ends 7, 12 and the nip points 8, 10 are one above the other. The ribbon 2 is severed by the cutter 11 in the strip-travel direction 2 upstream of the second nip point 10 and severed from the supplied ribbon 2 and into a single strip of sufficient length to form the loop 1 (see FIG. 5).

Severing of the ribbon 2 preferably occurs after the gripping at the second nip point 10 and optionally before the ends 7, 12 are pivoted or moved, in which case there is the advantage that both ends 7, 12 are freely movable for the purpose of pivoting or positioning. However, the severing can also occur only after pivoting or positioning. The cutter 11 is shown schematically in the figures as a pair of scissors.

As shown in FIG. 4, the strip 4 that has already been formed into a simple loop 1 extends between the first nip point 8 and the second nip point 10.

The simple loop 1 can either be fixed to the edge of the textile piece T or processed into another loop shape, such as for example a V-shaped or a U-shaped loop 1'.

If further processing of the simple loop 1 into a V-shaped loop is to be performed, one of the clamps 6 or 9 is moved relative to the other gripper 6 or 9 in the plane of the strip 4. For this purpose, for example, the gripper 6 or 9 is embodied as a belt drive with a support element opposite the belt drive, the strip 4 being arranged with its nip point 8 or 10 between the belt of the belt drive and the support element. The gripper 6 or 9 can gripper at the second nip point 8 or 10 and act as a positioning device for positioning the nip point 8 or 10. In this way, a V-shaped loop with ends 7, 12 next to each other is formed from the simple loop with ends 7, 12 one over the other. The loop can then be fixed to the textile piece T. This operation is not shown in the figures.

As shown in FIGS. 7 to 9, if a U-shaped loop 1' is to be formed from the simple loop 1, the leading end 7 is pivoted relative to the trailing end 12 and the second gripper 9 by a pivoting device (not shown) with the first gripper 6 rotating about a pivot axis 21 extending substantially parallel to the plane of the strip 4 of ribbon in order to form the U-shaped loop 1'. Subsequently or at the same time, the second gripper 9 is moved relative to the first gripper 6 in the plane of the strip 4 so that the U-shaped loop 1' is tensioned between the nip points 8, 10. The movement is shown particularly in FIG. 11, with the end before the movement being indicated by a dashed line and shown at 19. The movement takes place as indicated by the arrow 20, 20'.

For this purpose, the gripper 9 is a belt drive with a support element 18 situated for example opposite the belt drive, the strip 4 being positioned with its second nip point 10 between the belt of the belt drive 17 and the support element 18.

The gripper 9 can thus grip the second nip point 10 and act as an adjuster for moving the nip points 8, 10 away from each other. The combination of the two functions in one element is especially space-saving. The belt drive 17 acts as a conveyor with which the second nip point 10 can be moved away from the first nip point 8 parallel to the edge of the textile piece T. As soon as the strip 4 has been deformed into a U-shaped loop 1', movement of the nip points 8, 10 relative to each other can take place, and the loop 1' can be tensioned between the clamps 6, 9 as shown in FIG. 12.

The ends 7, 12 are positioned side by side, and ends 7 and 12 of the loop 1' can then be fixed to the textile piece T in any manner.

The adjacent ends 7, 12 project past the nip points 8, 10 and can be easily fixed to the textile piece T.

A positioning device that locates the ends 7, 12 at the edge of the textile piece T and a conveyor that transports the textile piece T with the positioned ends 7, 12 of the strip to a fastening device, and the fastening device that fastens the ends 7, 12 of the strip to the textile piece T in the correct position are not shown in the drawing.

The method and apparatus are especially simple and inexpensive to implement and can be consolidated in a compact apparatus and carried out. This eliminates costly modifications or conversion measures that have to be carried out with conventional methods and apparatuses when a changeover is made during production from one label format to another label format. With the present method and apparatus, it is sufficient to perform appropriate programming of the existing adjustable computer control for the functional and motion sequences in order for the desired method steps that are required for the desired label format to be made.

I claim:

1. A method comprising the steps of sequentially:

advancing a strip of the ribbon in a strip-travel direction extending parallel to the strip of ribbon from a ribbon supply;

gripping a leading end of the strip in the strip-travel direction at a first nip point while advancing additional ribbon from the ribbon supply;

gripping the strip at a second nip point spaced from the first nip point at a trailing end of the strip spaced upstream from the first nip point;

severing the ribbon upstream in the strip-travel direction of the second nip point to separate the strip from the ribbon into a single strip of sufficient length between the first nip point and the second nip points;

pivoting the leading end or the trailing end about at least one pivot axis relative to the other end, or positioning the leading end or the trailing end relative to the other end, or positioning both ends relative to each other in the plane of the strip or parallel to this plane so that a simple loop or a U-shaped loop or a V-shaped loop is formed in which the leading and trailing ends are oriented one above the other or overlap at least partially or are next to each other;

aligning the positioned leading and trailing ends are transverse to an edge of a textile piece and positioning the leading and trailing ends thereon, or aligning the leading and trailing ends from an aligning position that deviates from a transverse to the edge of the textile piece into a position in which they are positioned transverse to the edge of the textile piece; and fixing the loop at the ends to the textile piece.

2. The method defined in claim 1, wherein the strip-travel direction extends nonparallel and substantially transverse to the edge of the textile piece.

3. The method defined in claim 1, wherein the strip-travel direction extends parallel and/or transverse to a plane of the strip.

4. The method defined in claim 1, further comprising the step of:

moving the first nip point to entrain the leading end leading end parallel to the strip-travel direction of the ribbon.

5. The method defined in claim 4, further comprising the step of:

moving the leading end to and positioned the leading end in a position outside, below or above a strip-travel path; and advancing further in the strip-travel direction via the first nip point until a desired length has been reached.

6. The method defined in claim 1, wherein the step of severing the strip is carried out pivoting and/or positioning the leading or trailing end.

7. The method defined in claim 1, wherein the step of severing is carried out after the pivoting and/or the positioning of the leading or trailing end.

8. The method defined in claim 1, wherein the strip is advanced by the feeder through a shaping slide that is moved from a starting position while entraining the ribbon until reaching a desired end position at which the ribbon forms a simple loop during forward advancement, the first gripper gripping the leading end before the shaping slide reaches the desired end position and the shaping slide being moved rearward back to its starting position after reaching the end position and the leading end being held gripped by the first gripper for the entire displacement operation, gripping of the trailing end of the strip being continued during rearward displacement of the shaping slide into the starting position or after the shaping slide reaches the starting position.

9. The method defined in claim, wherein the ribbon is advanced intermittently.

10. A method comprising the steps of sequentially:

advancing a strip of ribbon in a strip-travel direction extending parallel to the strip from a ribbon supply;

gripping a leading end of the strip at a first nip point while advancing additional ribbon from the ribbon supply;

gripping the strip at a second nip point upstream in the strip-travel direction from the first nip point at a spacing of sufficient length between the first nip point and the second nip point to form a loop;

severing the ribbon upstream in the strip-travel direction of the second nip point to separate from the loop with the leading end and a trailing end gripped at the first and second nip points;

pivoting the leading end of the strip section about at least one pivot axis relative to the other end;

positioning the pivoted end relative to the other end;

aligning the leading end positioned in this way transverse to the edge of the textile piece and positioning it thereon; and fixing the loop at the leading end to the textile piece.

11. An apparatus comprising:

a conveyor for advancing a strip of ribbon in a strip-travel direction extending parallel to the strip from a ribbon supply;

a first gripper for gripping a leading end of the strip in the strip-travel direction at a first nip point;

a second gripper for gripping a trailing end of the strip at a second nip point spaced upstream in the direction from the first nip point to form between the nip points a loop of the strip of ribbon;

a cutter for severing the strip from the ribbon upstream of the trailing end of the strip and of the second nip point;

a pivoting device that can pivot the first gripper or the second gripper about at least one pivot axis relative to the other gripper, or an adjuster that can move the first nip point or the second nip point relative to the other nip point in a plane of the strip or parallel to this plane so that the strip of ribbon forms a simple loop or a U-shaped loop or a V-shaped loop whose ends are one above the other or overlap at least partially or are next to each other and are positionable on and fixable to the edge of the textile;

a positioning device for positioning the leading and trailing ends at the edge of the textile piece; and a conveyor that transports the textile piece with the positioned ends of the strip to a fastening device that attaches the leading and trailing ends of the strip to the textile piece.

12. The method defined in claim 11, wherein the strip-travel direction does not extend parallel to but is preferably aligned substantially transverse to the edge of the textile piece.

13. The method defined in claim 10, wherein the pivot axis is aligned substantially perpendicular and/or parallel to a plane of the strip of ribbon.

14. The method defined in claim 10, wherein the conveyor is a belt drive with a transport base, and the ribbon is advanced between a belt of the belt drive and the transport base.

15. The method defined in claim 14, wherein the transport base is a shaping slide and the belt drive or the shaping slide can be moved forward from a starting position in the strip-travel direction of the strip into a working position in which the ribbon is shaped into a simple loop and can be moved back into the starting position.

16. The method defined in claim 14, further comprising the steps of:

moving the belt drive into a conveying position in which the ribbon is pressed against the transport base by the belt of the belt drive and advanced over the transport base, and moving the belt drive from the conveying position to a rest position in which the belt drive frees the ribbon.

17. The method defined in claim 10, further comprising the step of:

moving the first gripper to entrain the leading end in the strip-travel direction or parallel to the strip-travel direction of the ribbon.

18. The method defined in claim 10, wherein at least one of the grippers has or is a conveyor with which the leading end and/or the trailing end can be moved away from the other end.

19. The method defined in claim 10, wherein the first and/or the second gripper is a belt drive with a support element opposite the belt drive, the strip being oriented with its first and/or second nip point between the belt of the belt drive or the feed roller and the support element.

20. The method defined in claim 10, wherein the first and/or the second gripper is adjustable and grips the strip being gripped at the first and/or second nip point between components.

21. The method defined in claim 10, wherein the leading and trailing ends project past the nip points and are fixable to the textile piece with their projecting portions.

* * * * *